US010245704B2

(12) United States Patent
Eilers et al.

(10) Patent No.: US 10,245,704 B2
(45) Date of Patent: Apr. 2, 2019

(54) COATED ABRASIVE ARTICLES

(75) Inventors: Deborah J. Eilers, Hastings, MN (US); Jeffrey R. Janssen, Woodbury, MN (US); Charles R. Wald, Oakdale, MN (US); Christopher J. Lee, Woodbury, MN (US); Schoen A. Schuknecht, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 140 days.

(21) Appl. No.: 13/175,461

(22) Filed: Jul. 1, 2011

(65) Prior Publication Data

US 2012/0000135 A1 Jan. 5, 2012

Related U.S. Application Data

(60) Provisional application No. 61/361,020, filed on Jul. 2, 2010.

(51) Int. Cl.

| | |
|---|---|
| ***B24D 3/28*** | (2006.01) |
| ***B24D 11/00*** | (2006.01) |
| ***B24D 18/00*** | (2006.01) |

(52) U.S. Cl.

CPC ..... *B24D 3/28* (2013.01); *B24D 11/001* (2013.01); *B24D 18/00* (2013.01)

(58) Field of Classification Search

None

See application file for complete search history.

(56) References Cited

U.S. PATENT DOCUMENTS

| | | | |
|---|---|---|---|
| 794,495 | A | 7/1905 | Gorton |
| 2,334,642 | A | 11/1943 | Moore |
| 2,820,746 | A | 1/1958 | Keeleric |
| 2,863,306 | A | 12/1958 | Bangs |
| 2,907,146 | A | 10/1959 | Dyar |
| 3,605,349 | A | 9/1971 | Anthon |
| 3,991,527 | A | 11/1976 | Maran |
| 4,317,660 | A | 3/1982 | Kramis |
| 4,751,138 | A | 6/1988 | Tumey |

(Continued)

FOREIGN PATENT DOCUMENTS

| | | |
|---|---|---|
| EP | 0004454 | 10/1979 |
| JP | 04-057679 | 2/1992 |

(Continued)

OTHER PUBLICATIONS

International Search Report PCT/US2011/041326 dated Sep. 29, 2011, 4 pgs.

*Primary Examiner* — Kaj K Olsen
*Assistant Examiner* — Ross J Christie

(57) ABSTRACT

Provided are abrasive articles in which the make layer, abrasive particle layer, and size layer are coated onto a backing according to a pre-determined coating pattern. All three components are generally in registration with each other, thereby providing a pervasive uncoated area extending across the backing. Advantageously, this configuration provides a coated abrasive that displays superior curl-resistance compared with previously disclosed abrasive articles. Moreover, this configuration resists loading, resists delamination, has enhanced flexibility, and decreases the quantity of raw materials required to achieve the same level of performance as conventional abrasive articles.

19 Claims, 4 Drawing Sheets

(56) References Cited

U.S. PATENT DOCUMENTS

| | | | | |
|---|---|---|---|---|
| 4,759,982 | A | 7/1988 | Jenssen | |
| 4,828,583 | A | 5/1989 | Oxman | |
| 4,925,457 | A | 5/1990 | deKok | |
| 4,930,266 | A * | 6/1990 | Calhoun et al. | 51/293 |
| 4,988,554 | A | 1/1991 | Peterson | |
| 5,014,468 | A * | 5/1991 | Ravipati et al. | 51/295 |
| 5,067,400 | A | 11/1991 | Bezella | |
| 5,437,754 | A | 8/1995 | Calhoun | |
| 5,549,962 | A | 8/1996 | Holmes | |
| 5,551,960 | A | 9/1996 | Christianson | |
| 5,578,096 | A * | 11/1996 | Christianson et al. | 51/295 |
| 5,700,302 | A | 12/1997 | Stoetzel | |
| 5,810,650 | A | 9/1998 | Jost | |
| 5,830,248 | A * | 11/1998 | Christianson et al. | 51/295 |
| 5,833,724 | A | 11/1998 | Wei | |
| 5,840,088 | A | 11/1998 | Yang | |
| 5,975,988 | A * | 11/1999 | Christianson | 451/28 |
| 6,217,413 | B1 * | 4/2001 | Christianson | 451/28 |
| 6,257,973 | B1 | 7/2001 | Fernand Guiselin | |
| 6,537,140 | B1 | 3/2003 | Miller | |
| 6,682,574 | B2 | 1/2004 | Carter | |
| 6,752,700 | B2 | 6/2004 | Duescher | |
| 6,769,969 | B1 * | 8/2004 | Duescher | 451/59 |
| 6,773,474 | B2 | 8/2004 | Koehnle | |
| 7,108,596 | B2 | 9/2006 | Nevoret | |
| 7,169,029 | B2 | 1/2007 | Petersen | |
| 7,329,175 | B2 | 2/2008 | Woo | |
| 7,384,437 | B2 | 6/2008 | Welygan | |
| 7,520,800 | B2 * | 4/2009 | Duescher | 451/527 |
| 2003/0176156 | A1 | 9/2003 | Braunschweig | |
| 2004/0180618 | A1 | 9/2004 | Suzuki | |
| 2004/0185763 | A1 | 9/2004 | Ishizaki | |
| 2004/0235406 | A1 * | 11/2004 | Duescher | 451/527 |
| 2005/0032469 | A1 * | 2/2005 | Duescher | 451/548 |
| 2005/0118939 | A1 * | 6/2005 | Duescher | B24D 11/00 451/527 |
| 2005/0282480 | A1 * | 12/2005 | Nelson | B24D 3/34 451/530 |
| 2006/0194038 | A1 * | 8/2006 | You et al. | 428/323 |
| 2006/0242910 | A1 * | 11/2006 | You | 51/297 |
| 2008/0148650 | A1 * | 6/2008 | You | 51/298 |
| 2009/0145044 | A1 * | 6/2009 | You | 51/298 |

FOREIGN PATENT DOCUMENTS

| | | |
|---|---|---|
| JP | 3000377 | 11/1999 |
| JP | 3008118 | 12/1999 |
| JP | 3008119 | 12/1999 |
| JP | 2003-071731 | 3/2003 |
| JP | 2006-136973 | 6/2006 |
| WO | WO 03/57409 | 7/2003 |
| WO | WO 03/57410 | 7/2003 |
| WO | WO 03/57411 | 7/2003 |

* cited by examiner

COATED ABRASIVE ARTICLES

RELATED APPLICATION DATA

This application claims the benefit of U.S. Provisional Application Ser. No. 61/361,020, filed Jul. 2, 2010, which is incorporated by reference herein in its entirety.

FIELD OF THE INVENTION

Coated abrasive articles are provided along with methods of making the same. More particularly, coated abrasive articles with patterned coatings are provided, along with methods of making the same.

BACKGROUND

Coated abrasive articles are commonly used for abrading, grinding and polishing operations in both commercial and industrial applications. These operations are conducted on a wide variety of substrates, including wood, wood-like materials, plastics, fiberglass, soft metals, enamel surfaces, and painted surfaces. Some coated abrasives can be used in either wet or dry environments. In wet environments, common applications include filler sanding, putty sanding, primer sanding and paint finishing.

In general, these abrasive articles include a paper or polymeric backing on which abrasive particles are adhered. The abrasive particles may be adhered using one or more tough and resilient binders to secure the particles to the backing during an abrading operation. In a manufacturing process, these binders are often processed in a flowable state to coat the backing and the particles, and then subsequently hardened to lock in a desired structure and provide the finished abrasive product.

In a common construction, the backing has a major surface that is first coated with a "make" layer. Abrasive particles are then deposited onto the make layer such that the particles are at least partially embedded in the make layer. The make layer is then hardened (e.g., crosslinked) to secure the particles. Then, a second layer called a "size" layer is coated over the make layer and abrasive particles and also hardened. The size layer further stabilizes the particles and also enhances the strength and durability of the abrasive article. Optionally, additional layers may be added to modify the properties of the coated abrasive article.

A coated abrasive article can be evaluated based on certain performance properties. First, such an article should have a desirable balance between cut and finish—that is, an acceptable efficiency in removing material from the workpiece, along with an acceptable smoothness of the finished surface. Second, an abrasive article should also avoid excessive "loading", or clogging, which occurs when debris or swarf become trapped between the abrasive particles and hinder the cutting ability of the coated abrasive. Third, the abrasive article should be both flexible and durable to provide for longevity in use.

SUMMARY

Wet abrasive applications can provide unique challenges. Abrasive sheets may be soaked in water for extended periods of time, sometimes for more than 24 hours. A particular problem encountered with commercial coated abrasive articles in wet environments is the tendency for these coated articles to curl. Curling of the abrasive article can be a significant nuisance to the user. A similar effect can also occur when abrasive articles are stored in humid environments. To mitigate curling, abrasive sheets are sometimes pre-flexed in the manufacturing process, but this is generally ineffective in preventing curling during use.

The present disclosure provides coated abrasive articles in which the make layer, abrasive particle layer, and size layer are coated onto a backing according to a coating pattern. All three components are substantially in registration with each other according to this pattern, thereby providing pervasive uncoated areas extending across the backing. Advantageously, this configuration provides a coated abrasive that displays superior curl-resistance compared with conventional abrasive articles. Moreover, this configuration resists loading, resists de-lamination, has enhanced flexibility, and decreases the quantity of raw materials required to achieve the same level of performance as conventional abrasive articles.

In one aspect, an abrasive article is provided. The abrasive article comprises a flexible backing having a major surface; a make resin contacting the major surface and extending across the major surface in a pre-determined pattern; abrasive particles contacting the make resin and generally in registration with the make resin as viewed in directions normal to the plane of the major surface; and a size resin contacting both the abrasive particles and the make resin, the size resin being generally in registration with both the abrasive particles and the make resin as viewed in directions normal to the plane of the major surface, wherein areas of the major surface contacting the make resin are coplanar with areas of the major surface not contacting the make resin.

In another aspect, an abrasive article is provided comprising a flexible backing having a generally planar major surface; and a plurality of discrete islands on the major surface, each island comprising: a make resin contacting the backing; abrasive particles contacting the make resin; and a size resin contacting the make resin, the abrasive particles, and the backing, wherein areas of the backing located between adjacent islands do not contact the make resin, abrasive particles, or size resin.

In still another aspect, an abrasive article is provided comprising a flexible backing having a major surface; a make resin contacting at least a portion of the major surface; abrasive particles contacting the make resin and generally in registration with the make resin as viewed in directions normal to the plane of the major surface; and a size resin contacting both the abrasive particles and the make resin and generally in registration with both the abrasive particles and the make resin as viewed in directions normal to the plane of the major surface, wherein the make resin has a coverage of at most 30 percent.

In yet another aspect, a method of making an abrasive article is provided, comprising selectively applying a make resin to a major surface of a generally planar backing such that the make resin coats a plurality of areas along the major surface; applying abrasive particles to the coated backing such that the abrasive particles preferentially coats the make resin; hardening the make resin; applying a size resin to the coated backing such that the size resin preferentially coats the abrasive particles and the make resin; and hardening the size resin.

In yet another aspect, a method of reducing curl in a coated abrasive article comprising a flexible backing having a generally planar surface; a make resin contacting the generally planar surface and extending across the generally planar surface in a pre-determined pattern; abrasive particles contacting the make resin and generally in registration with the make resin as viewed in directions normal to the plane of the generally planar surface; and a size resin contacting both the abrasive particles and the make resin, the size resin being generally in registration with both the abrasive particles and the make resin as viewed in directions normal to the plane of the generally planar surface is provided, the method comprising: maintaining uncoated areas of the generally planar surface located between the coated regions.

DEFINITIONS

As used herein:

"Feature" refers to an image that is defined by a selective coating process;

"Coverage" refers to the percentage of surface area of the backing eclipsed by the features over the area subjected to the selective coating process;

"Particle diameter" refers to the longest dimension of the particle; and

"Cluster" refers to a group of features located in proximity to each other.

DETAILED DESCRIPTION

Figure 1:
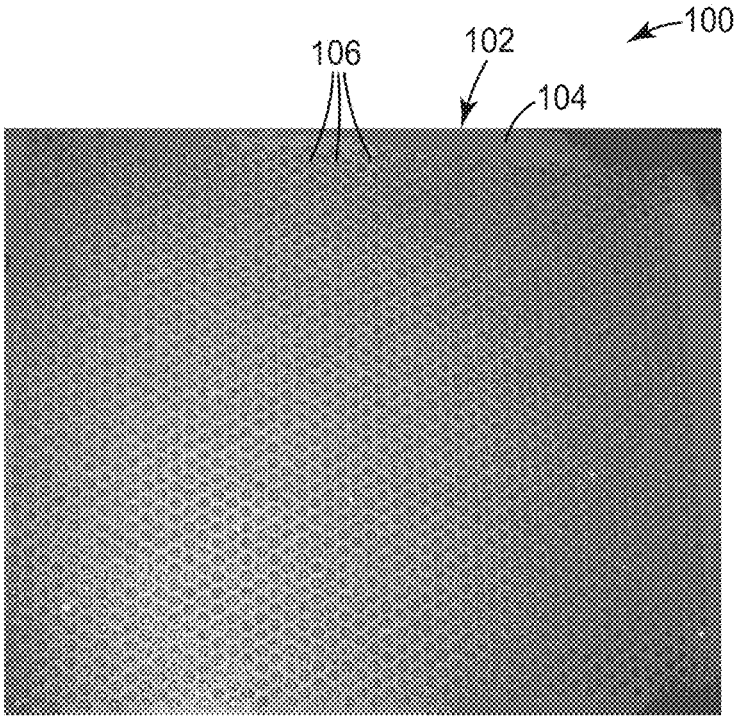
FIG. 1 is a plan view of an abrasive article according to one embodiment.

An abrasive article according to one exemplary embodiment is shown in FIG. 1 and is designated by the numeral 100. As shown, the abrasive article 100 includes a backing 102 having a planar major surface 104 approximately parallel to the plane of the page. A plurality of discrete clusters 106 are located on the major surface 104 and arranged in a pre-determined pattern. In this embodiment, the pattern is a two-dimensional ordered array. The abrasive article 100 occupies a planar rectangular region corresponding to the patterned region shown in FIG. 1.

Figure 2A:
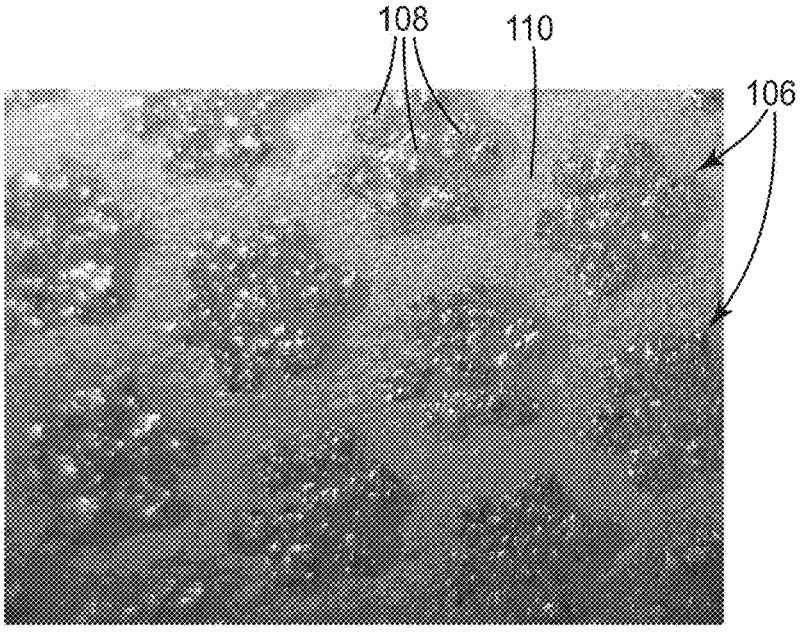
FIG. 2*a* is an enlarged view of a portion of the abrasive article in FIG. 1.

FIG. 2 shows the pattern of clusters 106 in greater detail. As shown in the figure, the clusters 106 are arranged in a hexagonal array in which each cluster 106 has six equidistant neighbors (excluding edge effects). Further, each individual cluster 106 is itself a hexagonal grouping of seven discrete abrasive features 108. As shown, each of the features 108 is generally circular in shape. However, other shapes such as squares, rectangles, lines and arcs, may also be used. In other embodiments, the features 108 are not clustered.

Notably, there are uncoated areas 110 of the major surface 104 surrounding each cluster 106 and located between neighboring clusters 106. Advantageously, during an abrading operation, the uncoated areas 110 provide open channels allowing swarf, dust, and other debris to be evacuated from the cutting areas where the features 108 contact the workpiece.

Figure 2B:
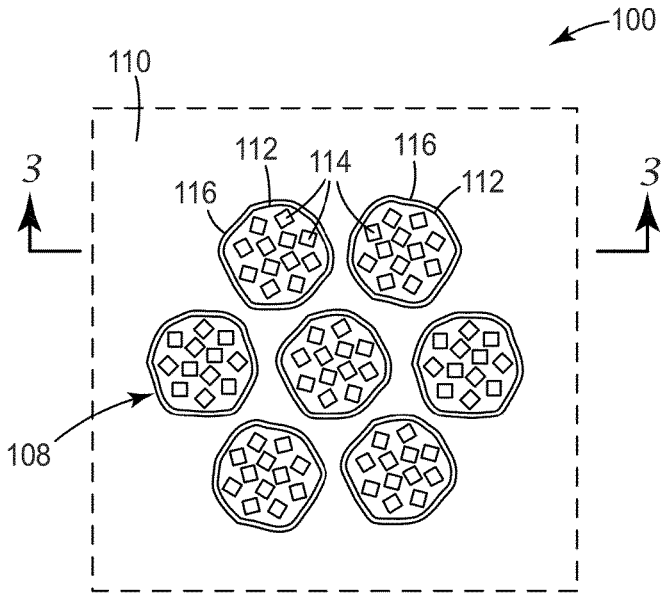
FIG. 2*b* is a further enlarged view of a sub-portion of the abrasive article in FIGS. 1 and 2*a;*
Figure 3:
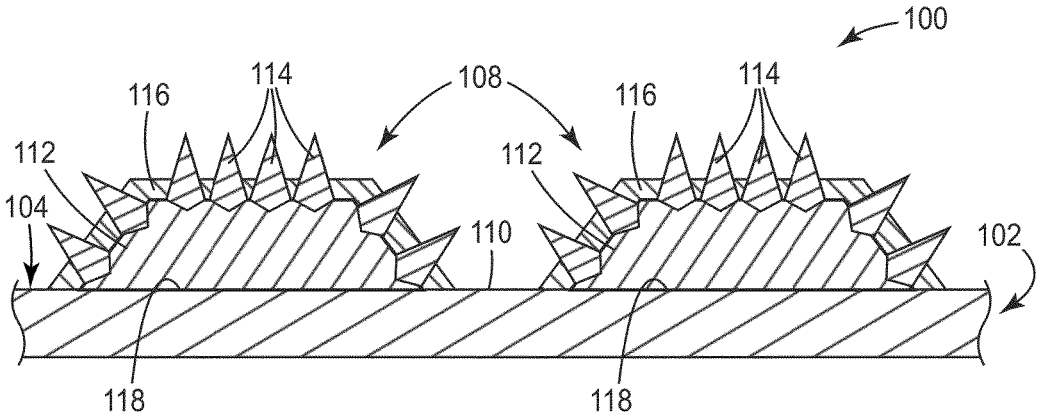
FIG. 3 is a cross-sectional view of the sub-portion of the abrasive article shown in FIGS. 1, 2*a*, and 2*b;*

FIG. 2*b* shows components of the features 108 in further detail and FIG. 3 shows two of the features 108 in cross-section. As shown in these figures, each feature 108 includes a layer of make resin 112 that is preferentially deposited onto the major surface 104 along an interface 118. The make resin 112 coats selective areas of the backing 102, thereby forming the base layer for each discrete feature 108, or "island", on the backing 102.

A plurality of abrasive particles 114 contact the make resin 112 and generally extend in directions away from the major surface 104. The particles 114 are generally in registration with the make resin 112 when viewed in directions normal to the plane of the major surface 104. In other words, the particles 114, as a whole, generally extend across areas of the major surface 104 that are coated by the make resin 112, but do not generally extend across areas of the major surface 104 that are not coated by the make resin 112. Optionally, the particles 114 are at least partially embedded in the make resin 112.

As further shown in FIG. 3, a size resin 116 contacts both the make resin 112 and the particles 114 and extends on and around both the make resin 112 and the particles 114. The size resin 116 is generally in registration with both the make resin 112 and the particles 114 when viewed in directions normal to the plane of the major surface 104. Like the abrasive particles 114, the size resin 116 generally extends across areas of the major surface 104 coated by the make resin 112, but does not generally extend across areas of the major surface 104 not coated by the make resin 112.

Optionally and as shown, the size resin 116 contacts the make resin 112, the abrasive particles 114, and the backing 102. As another option, essentially all of the abrasive particles 114 are encapsulated by the combination of the make and size resins 112, 116.

While the particles 114 are described here as being "generally in registration" with the make resin 112, it is to be understood that the particles 114 themselves are discrete in nature and have small gaps located between them. Therefore, the particles 114 do not cover the entire area of the underlying make resin 112. Conversely, it is to be understood that while the size resin 116 is "in registration" with make resin 112 and the particles 114, size resin 116 can optionally extend over a slightly oversized area compared with that covered by the make resin 112 and particles 114, as shown in FIG. 2*b*. In the embodiment shown, the make resin 112 is fully encapsulated by the size resin 116, the particles 114, and the backing 102.

Further, all of the features 108 on the backing 102 need not be discrete. For example, the make resin 112 associated with adjacent features 108 may be in such close proximity that the features 108 contact each other, or become interconnected. In some embodiments, two or more features 108 may be interconnected with each other within a cluster 106, although the features 108 in separate clusters 106 are not interconnected.

Preferably and as shown, the backing 102 is uniform in thickness and generally flat. As a result, the interface 118 where the major surface 104 contacts the make resin 112 is generally coplanar with the areas of the major surface 104 that do not contact the make resin 112 (i.e. uncoated areas 110). A backing 102 with a generally uniform thickness is preferred to alleviate stiffness variations and improve conformability of the article 100 to the workpiece. This aspect is further advantageous because it evenly distributes the stress on the backing, which improves durability of the article 100 and extends its operational lifetime.

The provided abrasive articles present a solution to particular problems with conventional coated abrasive sheets. One problem is that conventional abrasive sheets tend to curl in humid environments. Another problem is that these coated abrasive sheets often curl immediately when made, a phenomenon known as "intrinsic curl." To mitigate intrinsic curl, manufacturers can pre-flex these abrasive sheets, but this involves additional processing and still does not effectively address curl that is subsequently induced by the environment.

Unlike conventional abrasive articles, the provided abrasive articles have abrasive particles extending across a plurality of islands, or discrete coated regions, along the major surface, while uncoated areas of the major surface are maintained between the islands. It was discovered that when areas of the major surface surrounding these islands do not contact any of the make resin, abrasive particles, or size resin, these abrasive articles display superior resistance to curling when immersed in water or subjected to humid environments.

Additionally, these abrasive articles have substantially reduced curl when manufactured and reduce the need for pre-flexing of the abrasive sheets after the make and size resins have been hardened. When tested in accordance with the Dry Curl test (described in the Examples section below), the abrasive articles preferably display a curl radius of at least 20 centimeters, more preferably display a curl radius of at least 50 centimeters, and most preferably display a curl radius of at least 100 centimeters. When tested in accordance with the Wet Curl test (described in the Examples section below), the abrasive articles preferably display a curl radius of at least 2 centimeters, more preferably display a curl radius of at least 5 centimeters, and most preferably display a curl radius of at least 7 centimeters.

As a further advantage, these abrasive articles have been found to display a high degree of flexibility, since a substantial portion of the backing is uncoated. The greater flexibility in turn enhances durability. This is particularly shown by its high resistance to tearing and delamination when the abrasive article is subjected to crumpling under wet and dry conditions.

Other Coating Patterns

The abrasive article 100 described above uses a two-dimensional hexagonal coating pattern for the features 108. While the pattern is two-dimensional, the features 108 themselves have some thickness that results in a "feature height" perpendicular to the plane of the backing. However, other coating patterns are also possible, with some offering particular advantages over others.

In some embodiments, the pattern includes a plurality of replicated polygonal clusters and/or features, including ones in the shape of triangles, squares, rhombuses, and the like. For example, triangular clusters could be used where each cluster has three or more generally circular abrasive features. Since the abrasive features 108 increase the stiffness of the underlying backing 102 on a local level, the pattern of the abrasive article 100 may be tailored to have enhanced bending flexibility along preferred directions.

Figure 4:
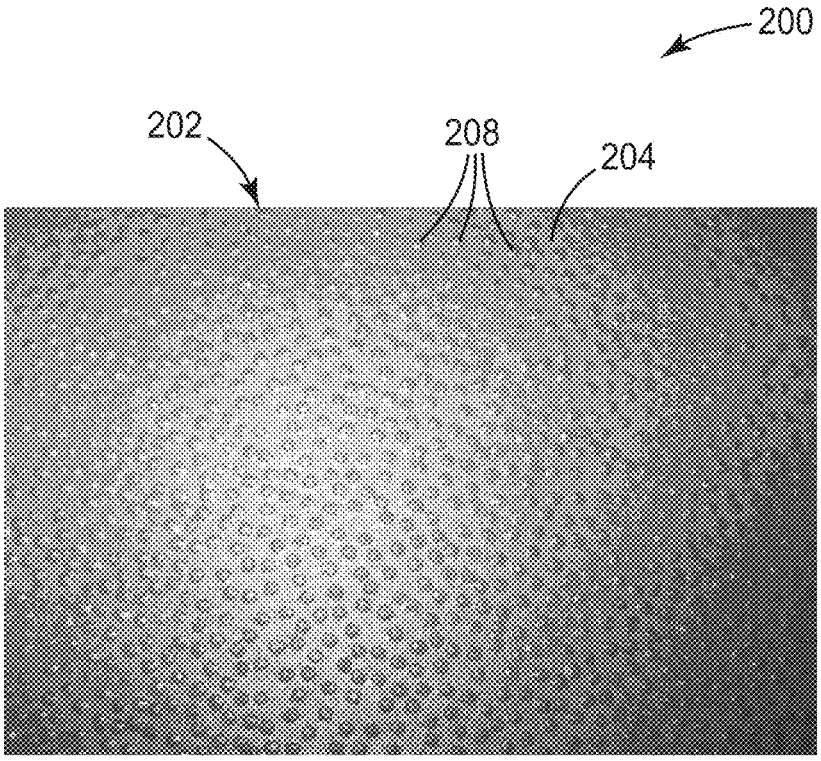
FIG. 4 is a plan view of an abrasive article according to another embodiment.

The coating pattern need not be ordered. For example, FIG. 4 shows an abrasive article 200 according to an alternative embodiment displaying a pattern that includes a random array of features. Like the article 100, the article 200 has a backing 202 with a major surface 204 and an array of discrete and generally circular abrasive features 208 that contact, and extend across, the major surface 204. However, the article 200 differs in that the features 208 are random. Optionally, the features 208 may be semi-random, or have limited aspects that are ordered. Advantageously, random patterns are non-directional within the plane of the major surface of the backing, helping minimize variability in cut performance. As a further advantage, a random pattern helps avoid creating systematic lines of weakness which may induce curling of the abrasive article along those directions.

Other aspects of article 200, including the configuration of the abrasive features 208, are analogous to those of article 100 and shall not be repeated here. Like reference numerals refer to like elements described previously.

The abrasive articles 100,200 preferably have an abrasive coverage (measured as a percentage of the major surface 104) that fits the desired application. On one hand, increasing abrasive coverage advantageously provides greater cutting area between the abrasive particles 114 and the workpiece. On the other hand, decreasing abrasive coverage increases the size of the uncoated areas 110. Increasing the size of the uncoated areas 110, in turn, can provide greater space to clear dust and debris and help prevent undesirable loading during an abrading operation.

Advantageously, low levels of abrasive coverage were nonetheless found to provide very high levels of cut, despite the relatively small cutting area between abrasive and the workpiece. In particular, it was found that fine grade abrasives could be coated onto the backing 102 at less than 50 percent coverage while providing cut performance similar to that of a fully coated sheet. Similarly, it was found that coarse grade abrasives could be coated onto the backing 102 at less than 20 percent coverage while providing cut performance similar to that of a fully coated sheet.

In some embodiments, the abrasive particles 114 have an average size (i.e. average particle diameter) ranging from 68 micrometers to 270 micrometers, while the make resin 112 has a coverage that is preferably at most 30 percent, more preferably at most 20 percent, and most preferably at most 10 percent. In other embodiments, the abrasive particles 114 have an average size ranging from 0.5 micrometers to 68 micrometers, while the make resin 112 has a coverage that is preferably at most 70 percent, more preferably at most 60 percent, and most preferably at most 50 percent.

Backings

The backing 102 may be constructed from various materials known in the art for making coated abrasive articles, including sealed coated abrasive backings and porous non-sealed backings. Preferably, the thickness of the backing generally ranges from about 0.02 to about 5 millimeters, more preferably from about 0.05 to about 2.5 millimeters, and most preferably from about 0.1 to about 0.4 millimeter, although thicknesses outside of these ranges may also be useful.

The backing may be made of any number of various materials including those conventionally used as backings in the manufacture of coated abrasives. Exemplary flexible backings include polymeric film (including primed films) such as polyolefin film (e.g., polypropylene including biaxially oriented polypropylene, polyester film, polyamide film, cellulose ester film), metal foil, mesh, foam (e.g., natural sponge material or polyurethane foam), cloth (e.g., cloth made from fibers or yarns comprising polyester, nylon, silk, cotton, and/or rayon), scrim, paper, coated paper, vulcanized paper, vulcanized fiber, nonwoven materials, combinations thereof, and treated versions thereof. The backing may also be a laminate of two materials (e.g., paper/film, cloth/paper, film/cloth). Cloth backings may be woven or stitch bonded.

The choice of backing material may depend, for example, on the intended application of the coated abrasive article. The thickness and smoothness of the backing should also be suitable to provide the desired thickness and smoothness of the coated abrasive article, wherein such characteristics of the coated abrasive article may vary depending, for example, on the intended application or use of the coated abrasive article.

The backing may, optionally, have at least one of a saturant, a presize layer and/or a backsize layer. The purpose of these materials is typically to seal the backing and/or to protect yarn or fibers in the backing. If the backing is a cloth material, at least one of these materials is typically used. The addition of the presize layer or backsize layer may additionally result in a 'smoother' surface on either the front and/or the back side of the backing. Other optional layers known in the art may also be used, as described in U.S. Pat. No. 5,700,302 (Stoetzel et al.).

Abrasive Particles

Suitable abrasive particles for the coated abrasive article 100 include any known abrasive particles or materials useable in abrasive articles. For example, useful abrasive particles include fused aluminum oxide, heat treated aluminum oxide, white fused aluminum oxide, black silicon carbide, green silicon carbide, titanium diboride, boron carbide, tungsten carbide, titanium carbide, diamond, cubic boron nitride, garnet, fused alumina zirconia, sol gel abrasive particles, silica, iron oxide, chromia, ceria, zirconia, titania, silicates, metal carbonates (such as calcium carbonate (e.g., chalk, calcite, marl, travertine, marble and limestone), calcium magnesium carbonate, sodium carbonate, magnesium carbonate), silica (e.g., quartz, glass beads, glass bubbles and glass fibers) silicates (e.g., talc, clays, (montmorillonite) feldspar, mica, calcium silicate, calcium metasilicate, sodium aluminosilicate, sodium silicate) metal sulfates (e.g., calcium sulfate, barium sulfate, sodium sulfate, aluminum sodium sulfate, aluminum sulfate), gypsum, aluminum trihydrate, graphite, metal oxides (e.g., tin oxide, calcium oxide), aluminum oxide, titanium dioxide) and metal sulfites (e.g., calcium sulfite), and metal particles (e.g., tin, lead, copper).

It is also possible to use polymeric abrasive particles formed from a thermoplastic material (e.g., polycarbonate, polyetherimide, polyester, polyethylene, polysulfone, polystyrene, acrylonitrile-butadiene-styrene block copolymer, polypropylene, acetal polymers, polyvinyl chloride, polyurethanes, nylon), polymeric abrasive particles formed from crosslinked polymers (e.g., phenolic resins, aminoplast resins, urethane resins, epoxy resins, melamine-formaldehyde, acrylate resins, acrylated isocyanurate resins, urea-formaldehyde resins, isocyanurate resins, acrylated urethane resins, acrylated epoxy resins), and combinations thereof.

Other exemplary abrasive particles are described, for example, in U.S. Pat. No. 5,549,962 (Holmes et al.). Abrasive articles may contain conventional abrasive agglomerates or individual abrasive grits or both.

The abrasive particles typically have an average diameter of from about 0.1 to about 270 micrometers, and more desirably from about 1 to about 1300 micrometers. Coating weights for the abrasive particles may depend, for example, on the binder precursor used, the process for applying the abrasive particles, and the size of the abrasive particles, but typically range from about 5 to about 1350 grams per square meter.

Make and Size Resins

Any of a wide selection of make and size resins 112, 116 known in the art may be used to secure the abrasive particles 114 to the backing 102. The resins 112, 116 typically include one or more binders having rheological and wetting properties suitable for selective deposition onto a backing.

Typically, binders are formed by curing (e.g., by thermal means, or by using electromagnetic or particulate radiation) a binder precursor. Useful first and second binder precursors are known in the abrasive art and include, for example, free-radically polymerizable monomer and/or oligomer, epoxy resins, acrylic resins, epoxy-acrylate oligomers, urethane-acrylate oligomers, urethane resins, phenolic resins, urea-formaldehyde resins, melamine-formaldehyde resins, aminoplast resins, cyanate resins, or combinations thereof. Useful binder precursors include thermally curable resins and radiation curable resins, which may be cured, for example, thermally and/or by exposure to radiation.

Exemplary radiation cured crosslinked acrylate binders are described in issued U.S. Pat. No. 4,751,138 (Tumey, et al.) and U.S. Pat. No. 4,828,583 (Oxman, et al.).

Supersize Resins

Optionally, one or more additional supersize resin layers are applied to the coated abrasive article 100. If a supersize resin is applied, it is preferably in registration with the make resin 112, particles 114, and size resin 116, as viewed in directions normal to the plane of the major surface of the backing. The supersize resin may include, for example, grinding aids and anti-loading materials. In some embodiments, the supersize resin provides enhanced lubricity during an abrading operation.

Curatives

Any of the make resin, size resin, and supersize resin described above optionally include one or more curatives. Curatives include those that are photosensitive or thermally sensitive, and preferably comprise at least one free-radical polymerization initiator and at least one cationic polymerization catalyst, which may be the same or different. In order to minimize heating during cure, while preserving pot-life of the binder precursor, the binder precursors employed in the present embodiment are preferably photosensitive, and more preferable comprise a photoinitiator and/or a photocatalyst.

Photoinitiators & Photocatalysts

The photoinitiator is capable of at least partially polymerizing (e.g., curing) free-radically polymerizable components of the binder precursor. Useful photoinitiators include those known as useful for photocuring free-radically polyfunctional acrylates. Exemplary photoinitiators include bis (2,4,6-trimethylbenzoyl)-phenylphosphineoxide, commercially available under the trade designation "IRGACURE 819" from BASF Corporation, Florham Park, N.J.; benzoin and its derivatives such as alpha-methylbenzoin; alpha-phenylbenzoin; alpha-allylbenzoin; alpha-benzylbenzoin; benzoin ethers such as benzil dimethyl ketal (e.g., as commercially available under the trade designation "IRGACURE 651" from BASF Corporation), benzoin methyl ether, benzoin ethyl ether, benzoin n-butyl ether; acetophenone and its derivatives such as 2-hydroxy-2-methyl-1-phenyl-1-propanone (e.g., as commercially available under the trade designation "DAROCUR 1173" from BASF Corporation. Photocatalysts as defined herein are materials that form active species that, if exposed to actinic radiation, are capable of at least partially polymerizing the binder precursor, e.g., an onium salt and/or cationic organometallic salt. Preferably, onium salt photocatalysts comprise iodonium complex salts and/or sulfonium complex salts. Aromatic onium salts, useful in practice of the present embodiments, are typically photosensitive only in the ultraviolet region of the spectrum. However, they can be sensitized to the near ultraviolet and the visible range of the spectrum by sensitizers for known photolyzable organic halogen compounds. Useful commercially available photocatalysts include an aromatic sulfonium complex salt having the trade designation "UVI-6976", available from Dow Chemical Co. Photoinitiators and photocatalysts useful in the present invention can be present in an amount in the range of 0.01 to 10 weight percent, desirably 0.01 to 5, most desirably 0.1 to 2 weight percent, based on the total amount of photocurable (i.e., crosslinkable by electromagnetic radiation) components of the binder precursor, although amounts outside of these ranges may also be useful.

Fillers

The abrasive coatings described above optionally comprise one or more fillers. Fillers are typically organic or inorganic particulates dispersed within the resin and may, for example, modify either the binder precursor or the properties of the cured binder, or both, and/or may simply, for example, be used to reduce cost. In coated abrasives, the fillers may be present, for example, to block pores and passages within the backing, to reduce its porosity and provide a surface to which the maker coat will bond effectively. The addition of a filler, at least up to a certain extent, typically increases the hardness and toughness of the cured binder. Inorganic particulate filler commonly has an average particle size ranging from about 1 micrometer to about 100 micrometers, more preferably from about 5 to about 50 micrometers, and sometimes even from about 10 to about 25 micrometers. Depending on the ultimate use of the abrasive article, the filler typically has a specific gravity in the range of 1.5 to 4.5, and an average particle size of the filler will preferably be less than the average particle size of the abrasive particles. Examples of useful fillers include: metal carbonates such as calcium carbonate (in the form of chalk, calcite, marl, travertine, marble or limestone), calcium magnesium carbonate, sodium carbonate, and magnesium carbonate; silicas such as quartz, glass beads, glass bubbles and glass fibers; silicates such as talc, clays, feldspar, mica, calcium silicate, calcium metasilicate, sodium aluminosilicate, sodium-potassium alumina silicate, and sodium silicate; metal sulfates such as calcium sulfate, barium sulfate, sodium sulfate, aluminum sodium sulfate, and aluminum sulfate; gypsum; vermiculite; wood flour; alumina trihydrate; carbon black; metal oxides such as calcium oxide (lime), aluminum oxide, titanium dioxide, alumina hydrate, alumina monohydrate; and metal sulfites such as calcium sulfite.

Viscosity Enhancers

Other useful optional additives in the present embodiment include viscosity enhancers or thickeners. These additives may be added to a composition of the present embodiment as a cost savings measure or as a processing aid, and may be present in an amount that does not significantly adversely affect properties of a composition so formed. Increase in dispersion viscosity is generally a function of thickener concentration, degree of polymerization, chemical composition or a combination thereof. An example of a suitable commercially available thickener is available under the trade designation "CAB-O-SIL M-5" from Cabot Corporation, Boston, Mass.

Other Functional Additives

Other useful optional additives in the present embodiment include anti-foaming agents, lubricants, plasticizers, grinding aids, diluents, coloring agents and process aids. Useful anti-foaming agents include "FOAMSTAR S125" from Cognis Corporation, Cincinnati, Ohio. Useful process aids include acidic polyester dispersing agents which aid the dispersion of the abrasive particles throughout the polymerizable mixture, such as "BYK W-985" from Byk-Chemie, GmbH, Wesel, Germany.

Methods of Making

In one exemplary method of making the article 100, the make resin 112 is preferentially applied to the major surface 104 of the backing 102 in a plurality of discrete areas that provide a random or ordered array on the major surface 104 as illustrated, for example, in FIGS. 1 and 4. Next, abrasive particles 114 are applied to the discrete areas of the make resin 112, and the make resin 112 is hardened. Optionally, the mineral can be applied over the entire sheet and then removed from those areas that do not contain the make resin 112. A size resin is then preferentially applied over the abrasive particles 114 and the make resin 112 and in contact with backing 102 (but it is not applied to the open areas 110 on the backing 102). Finally, the size resin 116 is hardened to provide the abrasive article 100.

In more detail, the selective application of the make resin 112 and size resin 116 can be achieved using contact methods, non-contact methods, or some combination of both. Suitable contact methods include mounting a template, such as a stencil or woven screen, against the backing of the article to mask off areas that are not to be coated. Non-contact methods include inkjet-type printing and other technologies capable of selectively coating patterns onto the backing without need for a template.

One applicable contact method is stencil printing. Stencil printing uses a frame to support a resin-blocking stencil. The stencil forms open areas allowing the transfer of resin to produce a sharply-defined image onto a substrate. A roller or squeegee is moved across the screen stencil, forcing or pumping the resin or slurry past the threads of the woven mesh in the open areas.

Screen printing is also a stencil method of print making in which a design is imposed on a screen of silk or other fine mesh, with blank areas coated with an impermeable substance, and the resin or slurry is forced through the mesh onto the printing surface. Advantageously, printing of lower profile and higher fidelity features can be enabled by screen printing. Exemplary uses of screen printing are described in U.S. Pat. No. 4,759,982 (Janssen et al.).

Yet another applicable contact method uses a combination of screen printing and stencil printing, where a woven mesh is used to support a stencil. The stencil includes open areas of mesh through which make resin/size resin can be deposited in the desired pattern of discrete areas onto the backing.

Another possible contact method for preparing these constructions is a continuous kiss coating operation where the size coat is coated in registration over the abrasive mineral by passing the sheet between a delivery roll and a nip roll. Optionally, the acrylate make resin can be metered directly onto the delivery roll. The final coated material can then be cured to provide the completed article.

Figure 5:
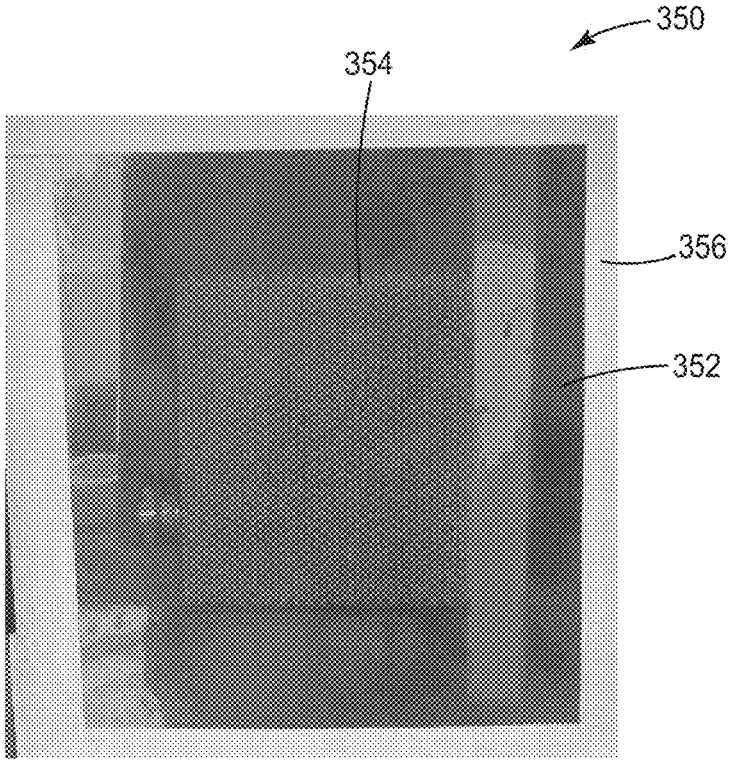
FIG. 5 is a plan view of a template providing the pattern for the features of the article in FIGS. 1-3.

FIG. 5 shows a stencil 350 for preparing the patterned coated abrasive articles shown in FIGS. 1-3. As shown, the stencil 350 includes a generally planar body 352 and a plurality of perforations 354 extending through the body 352. Optionally and as shown, a frame 356 surrounds the body on four sides. The stencil 350 can be made from a polymer, metal, or ceramic material and is preferably thin. Combinations of metal and woven plastics are also available. These provide enhanced flexibility of the stencil. Metal stencils can be etched into a pattern. Other suitable stencil materials include polyester films that have a thickness ranging from 1 to 20 mils (0.076 to 0.51 millimeters), more preferably ranging from 3 to 7 mils (0.13 to 0.25 millimeters).

Figure 6:
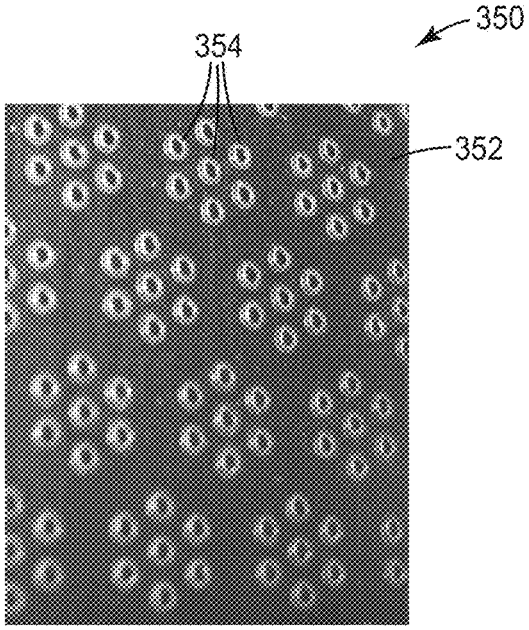
FIG. 6 is an enlarged fragmentary view of the template in FIG. 5, showing features of the template in greater detail.

FIG. 6 shows features of the stencil 350 in greater detail. As indicated in the figure, the perforations 354 assume the hexagonal arrangement of clusters and features as described previously for article 100. In some embodiments, the perforations are created in a precise manner by uploading a suitable digital image into a computer which automatically guides a laser to cut the perforations 354 into the stencil body 352.

The stencil 350 can be advantageously used to provide precisely defined coating patterns. In one embodiment, a layer of make resin 112 is selectively applied to the backing 102 by overlaying the stencil 350 on the backing 102 and applying the make resin 112 to the stencil 350. In some embodiments, the make resin 112 is applied in a single pass using a squeegee, doctor blade, or other blade-like device. Optionally, the stencil 350 is removed prior to hardening of the make resin 112. If so, the viscosity of the make resin 112 is preferably sufficiently high that there is minimal flow out that would distort the originally printed pattern.

The mineral particles 114 can be deposited on the layer of make resin 112 using a powder coating process or electrostatic coating process. In electrostatic coating, the abrasive particles 114 are applied in an electric field, allowing the particles 114 to be advantageously aligned with their long axes normal to the major surface 104. In some embodiments, the mineral particles 114 are coated over the entire coated backing 102 and the particles 114 preferentially bond to the areas coated with the tacky make resin 112. After the particles 114 have been preferentially coated onto the make resin 112, the make resin 112 is then partially or fully hardened. In some embodiments, the hardening step occurs by subjecting the abrasive article 100 at elevated temperatures, exposure to actinic radiation, or a combination of both, to crosslink the make resin 112. Excess particles are then removed from the uncoated areas of the backing 102.

In an exemplary final coating step, the stencil 350 is again overlaid on the coated backing 102 and positioned with the perforations 354 in registration with the previously hardened make resin 112 and abrasive particles 114. Then, the size resin 116 is preferentially applied to the hardened make resin 112 and abrasive particles 114 by applying the size resin 116 to the stencil 350. Preferably, the size resin 116 has an initial viscosity allowing the size resin 116 to flow and encapsulate exposed areas of the abrasive particles 114 and the make resin 112 prior to hardening. In some embodiments, the stencil 350 is removed prior to hardening of the size resin. Alternatively, the hardening occurs prior to removal of the stencil 350. Finally, the size resin 116 is hardened to provide the completed abrasive article 100.

Optional Features

If desired, the abrasive articles 100, 200 may include one or more additional features that further enhance ease of use, performance or durability. For example, the articles optionally include a plurality of dust extraction holes that are connected to a source of vacuum to remove dust and debris from the major surface of the abrasive articles.

As another option, the backing 102, 202 may include a fibrous material, such as a scrim or non-woven material, facing the opposing direction from the major surface 104, 204. Advantageously, the fibrous material can facilitate coupling the article 100, 200 to a power tool. In some embodiments, for example, the backing 102, 202 includes one-half of a hook and loop attachment system, the other half being disposed on a plate affixed to the power tool. Alternatively, a pressure sensitive adhesive may be used for this purpose. Such an attachment system secures the article 100, 200 to the power tool while allowing convenient replacement of the article 100, 200 between abrading operations.

Additional options and advantages of these abrasive articles are described in U.S. Pat. No. 4,988,554 (Peterson, et al.), U.S. Pat. No. 6,682,574 (Carter, et al.), U.S. Pat. No. 6,773,474 (Koehnle et al.), and U.S. Pat. No. 7,329,175 (Woo et al.)

EXAMPLES

Unless otherwise noted, all parts, percentages, ratios, etc. in the examples and the rest of the specification are by weight, and all reagents used in the examples were obtained, or are available, from general chemical suppliers such as, for example, Sigma-Aldrich Company, Saint Louis, Mo., or may be synthesized by conventional methods.

The following abbreviations are used to describe the examples:

° C.: degrees Centigrade
° F.: degrees Fahrenheit
cm: centimeters
cm/s: centimeters per second
cpm centimeters per minute
fpm feet per minute
$g/m^2$: grams per square meter
kPa: kilopascals
mil: $10^{-3}$ inches
μ-inch: $10^{-6}$ inches
μm: micrometers
oz: ounce
psi: pounds per square inch
UV ultraviolet
W Watts BB-077: A 70% aqueous phenolic resin, obtained under the trade designation "BB077" from Arclin Mississauga, Mississauga, Ontario, Canada.

CM-5: A fumed silica, obtained under the trade designation "CAB-O-SIL M-5" from Cabot Corporation, Boston, Mass.

CPI-6976: A triarylsulfonium hexafluoroantimonate/propylene carbonate photoinitiator, obtained under the trade designation "CYRACURE CPI 6976" from Dow Chemical Company, Midland, Mich.

CWT: A C-weight olive brown paper, obtained from Wausau Paper Company, Wausau, Wis., subsequently saturated with a styrene-butadiene rubber in order to make it waterproof.

D-1173: A α-Hydroxyketone photoinitiator, obtained under the trade designation "DAROCUR 1173" from BASF Corporation, Florham Park, N.J.

EPON-828: A difunctional bisphenol-A epoxy/epichlorohydrin derived resin having an epoxy equivalent wt. of 185-192, obtained under the trade designation "EPON 828" from Hexion Specialty Chemicals, Columbus, Ohio.

FS-125: A defoamer, obtained under the trade designation "FOAMSTAR S125" from Cognis Corporation, Cincinnati, Ohio.

F150X: A P150 grade aluminum oxide mineral, obtained under the trade designation "ALODUR FRPL P150" from Treibacher Industrie AG, Althofen, Austria.

GC-80: An 80 grade silicon carbide mineral, obtained under the trade name
"CARBOREX C-5-80" from Washington Mills Electro Minerals Corporation, Niagara Falls, N.Y.

GC-150: A GC-150 grade silicon carbide mineral, obtained under the trade name "CARBOREX C-5-150" from Washington Mills Electro Minerals Corporation.

I-819: A bis-acyl phosphine photoinitiator, obtained under the trade designation "IRGACURE 819" from BASF Corporation.

IW-33: Polyethylene glycol monooleate, obtained under the trade designation "INTERWET-33" from Akcros Chemicals, Inc., New Brunswick, N.J.

MX-10: A sodium-potassium alumina silicate filler, obtained under the trade designation "MINEX 10" from The Cary Company, Addison, Ill.

Q-325: A calcium carbonate powder, nominally having an average particle size of 15 μm, obtained under the trade designation "HUBERCARB Q325" from J.M. Huber Corporation, Atlanta, Ga.

SR-351: trimethylol propane triacrylate, available under the trade designation "SR351" from Sartomer Company, LLC.

UVR-6110: 3,4-epoxy cyclohexylmethyl-3,4-epoxy cyclohexylcarboxylate, obtained from Daicel Chemical Industries, Ltd., Tokyo, Japan.

Urea: Obtained from Mallinckrodt Baker, Inc., Phillipsburg, N.J.

W-985: An acidic polyester surfactant, obtained under the trade designation "BYK W-985" from Byk-Chemie, GmbH, Wesel, Germany.

Testing

Dry Curl Test.

A 4.5 by 5.5 inch (11.4 by 14.0 cm) sample sheet was conditioned at 90° F. (32.2° C.) and 90% relative humidity for 4 hours, after which the 5.5 inch (14.0 cm) edge was centered perpendicularly on an aluminum plate having a series of arcs marked thereon. The amount of curl reported corresponds to the radius of the arc traced by the curled sample sheet, that is, the larger the number, the flatter the sample.

Wet Curl Test.

Similar to the Dry Curl Test, except the sample sheet was soaked in water at 70° F. (21.1° C.) for 60 minutes rather than conditioned at 90° F. (32.2° C.) and 90% relative humidity. Curl was measured immediately after removing the sample from the water.

Sanding Test.

Coated abrasives were laminated to a dual sided adhesive film, and die cut into 4-inch (10.2 cm) diameter discs. The laminated coated abrasive was secured to the driven plate of a Schiefer Abrasion Tester, obtained from Frazier Precision Co., Gaithersburg, Md., which had been plumbed for wet testing. Disc shaped cellulose acetate butyrate (CAB) plastic workpieces, 4-inch (10.2 cm) outside diameter by 1.27 cm thick, available under the trade designation "POLYCAST" were obtained from Preco Laser, Somerset, Wis. The initial weight of each workpiece was recorded prior to mounting on the workpiece holder of the Schiefer tester. The water flow rate was set to 60 grams per minute. A 14 pound (6.36 kg) weight was placed on the abrasion tester weight platform and the mounted abrasive specimen lowered onto the workpiece and the machine turned on. The machine was set to run for 500 cycles and then automatically stop. After each 500 cycles of the test, the workpiece was rinsed with water, dried and weighed. The cumulative cut for each 500-cycle test was the difference between the initial weight and the weight following each test, and is reported as the average value of 4 measurements.

Surface Finish Measurement.

The surface finish of a workpiece is defined by Rz and Ra. Rz is the arithmetic average of the magnitude of the departure (or distance) of the five tallest peaks of the profile from the meanline and the magnitude of the departure (or distance) of the five lowest valleys of the profile from its meanline. Ra, is the arithmetic mean of the magnitude of the departure (or distance) of the profile from its meanline. Both Rz and Ra were measured at three locations for each disc or panel that was sanded using a profilometer, available under the trade designation "SURTRONIC 25 PROFILOMETER" from Taylor Hobson, Inc., Leicester, England. The length of scan was 0.03 inches (0.0762 centimeters).

Sample Preparation

Phenolic Make Coat.

1,264.0 grams BB077 was weighed into a 64 oz. (1.89 liter) plastic container. A premix solution containing 148.0 grams of a 34% aqueous urea solution, 1.1 grams IW-33 and 0.54 grams FS-125, was dispersed for 10 minutes at 70° F. (21.1° C.) in the resin using a high speed mixer, model number "SERIES 2000 MODEL 84" from Premier Mill Corporation, Reading, Pa. 400.0 grams Q-325 was then added, followed by 25.0 grams CM-5, and mixing continued until homogeneously dispersed (approximately 20 minutes).

Phenolic Size Coat.

750.0 grams BB077 was charged into a 64 oz. (1.89 liter) plastic container. A premix containing 240.0 grams water, 2.0 grams IW-33 and 1.0 grams FS-125, was dispersed for 10 minutes at 70° F. (21.1° C.) in the resin using the high speed mixer. 13.0 grams CM-5 was then added and mixing continued until homogeneously dispersed (approximately 20 minutes).

Acrylate Make Coat.

90.0 grams EPON-828, 63.3 grams UVR-6110, and 63.3 grams SR-351 were charged into a 16 oz. (0.47 liter) black plastic container and dispersed in the resin for 5 minutes at 70° F. (21.1° C.) using the high speed mixer. To that mixture, 1.5 grams W-985 was added and dispersed for 3 minutes at 70° F. (21.1° C.). With the mixer still running, 100.0 grams of MX-10 was gradually added over approximately 15 minutes. Finally, 6.3 grams CPI-6976 and 0.25 grams I-819 were added to the resin and dispersed until homogeneous (approximately 5 minutes).

Acrylate Size Coat.

400.0 grams EPON-828, 300.0 grams UVR-6110, and 300.0 grams SR-351 were charged into a 16 oz. (0.47 liter) black plastic container and dispersed in the resin for 5 minutes at 70° F. (21.1° C.) using the high speed mixer. To that mixture 30.0 grams CPI-6976 and 10.0 grams D-1173 were added and dispersed until homogeneous (approximately 10 minutes).

Stencil 1.

31 inch by 23 inch (78.74 by 58.42 cm) sheets of 5 mil (127.0 μm) thick polyester film, were perforated using an EAGLE MODEL 500 W $CO_2$ laser, obtained from Preco Laser, Inc., Somerset, Wis. The conditions used to make the stencil pattern illustrated in FIG. 6 are listed in TABLE 1.

TABLE 1

| | |
|---|---|
| Perforation Diameter | 30 mils (762 μm) |
| Perforation Distribution | 7 Perforations per Hexagonal Array |
| Perforation Area (%) | 7.6 |
| Laser Power (W) | 50 |
| Speed - Mark | 45 (inches/s)<br>114.3 (cm./s) |

TABLE 1-continued

| | |
|---|---|
| Laser Beam Diameter | 5 mils (127 μm) |

Stencil 2.

A rotary stainless steel stencil, having a 10 inch (25.4 cm) crossweb random distribution of 47.24 mils (1200 μm) diameter perforations and a perforation area of 26%, obtained from Rothtec Engraving Corporation, New Bedford, Mass.

Mesh 1.

A flatbed 23 by 31 inch (58.42 by 78.74 cm) aluminum framed linear patterned polyester screen printing mesh, having a 158 mesh count, obtained from Photo Etch Technology, Lowell, Mass. The print area was 9 by 11 inches (22.86 by 27.94 cm), with perforation diameter of 20 mils (508 μm) and a perforation area of 16%.

Stencil and Mesh Printed Abrasives

In the examples below, a stencil or mesh was used with a screen printer to provide the desired pattern.

Example 1

Stencil 1 was taped into the screen frame of a screen printer, model number "AT-1200H/E" from ATMA Champ Ent. Corp., Taipei, Taiwan. A 12 inch by 20 inch (30.48 by 50.8 cm) sheet of CWT paper was taped to a 12 inch by 20.25 inch (30.48 by 51.44 cm) steel panel, and the panel secured in registration within the screen printer. Approximately 75 grams of the phenolic make coat was spread over the stencil at 70° F. (21.1° C.) using a urethane squeegee, then stencil printed onto the paper backing. The steel paneland coated paper assembly was immediately removed from the screen printer. Mineral GC-80 was electrostatically applied to the phenolic make resin using a powder coater, type "EASY 01-F/02-F" from ITW Gema, St. Gallen, Switzerland, and cured in an oven for 30 minutes at 230° F. (110° C.). Meanwhile, the stencil was cleaned using ethanol soaked paper towels. The steel paneland coated paper assembly was removed from the oven, allowed to cool. Excess mineral removed by lightly brushing the coated surface and the assembly again secured within the screen printer in registration with the stencil. The phenolic size coat was applied in registration over the abrasive mineral per the same method as used to apply the phenolic make coat, and the assembly oven cured for 40 minutes at 240° F. (115.6° C.). After curing the coated paper was removed from the steel panel.

Example 2

The general procedure as described in Example 1 was repeated, wherein the GC-80 abrasive mineral was substituted with F150X.

Example 3

Stencil 1 was taped into the frame of small screen printer, obtained from APR Novastar, LLC, Huntington Valley, Pa. A 12 inch by 20 inch (30.48 by 50.8 cm) sheet of CWT paper was taped to a steel panel that was placed onto the printer backing plate, and the steel panel secured in registration within the screen printer. Approximately 35 grams of the acrylate make coat was spread over the stencil at 70° F. (21.1° C.) using a urethane squeegee, then stencil printed onto the paper backing. The steel panel and coated paper assembly was immediately removed from the screen printer. Mineral GC-80 was electrostatically applied to the acrylate make resin using the powder coater, and cured by passing twice through a UV processor, available from American Ultraviolet Company, Murray Hill, N.J., using two V-bulbs in sequence operating at 400 W/inch (157.5 W/cm) and a web speed of 40 ft/min (12.19 m/min), and allowed to cool. Meanwhile, the stencil was cleaned using ethanol soaked paper towels. Excess mineral was removed by lightly brushing the coated surface and the assembly again secured within the screen printer in registration with the stencil. The acrylate size coat was applied in registration over the abrasive mineral per the same method as used to apply the acrylate make coat, and the assembly cured by passing once through the UV processor at 400 W/inch (157.5 W/cm) and a web speed of 40 ft/min (12.19 m/min), followed by thermally curing for 5 minutes at 284° F. (140° C.). After curing the assembly was allowed to cool and the abrasive coated paper removed from the steel panel.

Example 4

Mesh 1 was mounted onto the screen printer used in Example 1. A 12 inch by 20 inch (30.48 by 50.8 cm) sheet of CWT paper was taped to the printer backing plate, and the plate secured in registration within the screen printer. Approximately 75 grams of the acrylate make coat was spread over the stencil at 70° F. (21.1° C.) using a urethane squeegee, then stencil printed onto the paper backing. The backing plate and coated paper assembly was immediately removed from the screen printer. Mineral GC-150 was electrostatically applied to the acrylate make resin according to the method described in Example 1, UV cured using the processor and conditions used in Example 3, after which excess mineral was removed by lightly brushing the coated surface. The acrylate size resin was then kiss coated in registration over the abrasive mineral by passing the sheet between a rubber coated fluid delivery roll and a stainless steel nip roll, wherein the acrylate size resin was metered onto the delivery roll using a No. 16 Meyer Rod. The material was then UV and thermally cured according to the method described in Example 3.

Comparative C-1.

The general procedure as described in Example 1 was repeated for applying and curing the phenolic make coat and mineral. Rather than stencil coating in registration, the phenolic size coat was instead applied over the entire 12 by 20 inch (30.48 by 50.8 cm) sheet of make and mineral coated CWT paper using a 12-inch (25.4 cm) roll coater, obtained from Eagle Tool Company, Minneapolis, Minn., at a nip pressure of 50 psi (344.7 kPa), at 70° F. (21.1° C.). The assembly was then oven cured for 40 minutes at 240° F. (115.6° C.), after which it was allowed to cool and the coated paper removed from the steel panel.

Comparative C-2.

The general procedure as described in Comparative C-1 was repeated, wherein the abrasive mineral GC-80 was substituted with F150X.

Comparative C-3

The general procedure as described in Example 3 was repeated for applying and curing the acrylate make coat and mineral. Rather than stencil coating in registration, the acrylate size coat was instead applied over the entire 12 by 20 inch (30.48 by 50.8 cm) sheet of make and mineral coated CWT paper using the roll, at a nip pressure of 50 psi (344.7 kPa), at 70° F. (21.1° C.). The assembly was then cured by passing once through the UV processor at 400 W/inch (157.5 W/cm) and a web speed of 40 ft/min (12.19 m/min), followed by thermally curing for 5 minutes at 284° F. (140° C.). After curing the assembly was allowed to cool and the abrasive coated paper removed from the steel panel.

Comparative C-4.

Stencil 2 was mounted onto rotary screen printer, model "RMR83", obtained from Zimmer America Corporation Machinery Division, Cowpens, S.C. An 11 inch (27.94 cm) width roll of CWT paper was mounted at one end of the web path. Approximately 1500 grams of the acrylate make coat resin, at 70° F. (21.1° C.), was placed in a pressure pot and metered through a dip tube to the center of the rotary screen. A magnetic rod then pulled the screen toward the backing forcing the resin through the stencil to create a random pattern of resin dots approximately 39.37 mils (1000 μm) in diameter and 12.2 mils (310 μm) high. The coated paper was moved down the web path at 15 fpm (457.2 cpm) and GC-150 was electrostatically applied to the resin dots using a powder coater, model "EASY 01-F/02-F" obtained from ITW Gema, St. Gallen, Switzerland. The coated paper passed through to a 2-D bulb UV processor, model "CW2", obtained from Nordson UV Systems, Manchester, England, at 1800 mJ/cm$^2$. Residual mineral was then removed using a workshop vacuum with a bristle attachment, model "RIDGID WD14500", obtained from Emerson Electrical Co., St. Louis, Mo. An 11 by 20 inch (27.94 by 50.8 cm) sample was cut from the coated paper, taped to a carrier web, and the acrylate size coat resin applied continuously over the entire surface using an anilox-flexographic-impression nip roll coater. The material was cured by passing it through the UV processor at 15 fpm (457.2 cpm) and 1800 mJ/cm$^2$, then thermally curing for 5 minutes at 284° F. (140° C.).

A summary of the example and comparative constructions are listed in Table 2, and test results are provided in Table 3. In Table 2 below, "continuous" indicates that the coating essentially covers the entire surface of the sheet, with the possible exception of common coating defects such as pinholes and the like.

TABLE 2

| Example | Make & Size Coat Composition | Mineral | Size Coat Coverage | Total Coating Weight (g/m$^2$) |
|---|---|---|---|---|
| 1 | Phenolic | GC-80 | In registration | 71.6 |
| 2 | Phenolic | F150X | In registration | 57.42 |
| 3 | Acrylate | GC-80 | In registration | 315.0 |
| 4 | Acrylate | GC-150 | In registration | 58.12 |
| Comparative C-1 | Phenolic | GC-80 | Continuous | 83.8 |
| Comparative C-2 | Phenolic | F150X | Continuous | 73.8 |
| Comparative C-3 | Acrylate | GC-80 | Continuous | 535.5 |
| Comparative C-4 | Acrylate | GC-150 | Continuous | 57.48 |

TABLE 3

| Sample | Curl Inches (cm) Wet | Curl Inches (cm) Dry | Cut (grams) | Finish μ-inch (μm) Ra | Finish μ-inch (μm) Rz |
|---|---|---|---|---|---|
| Example 1 | 0.75 (1.91) | 9.0 (22.86) | 6.195 | 188 (4.76) | 1103 (28.02) |
| Example 2 | 1.1 (2.79) | 20.0 (50.80) | 4.346 | 103 (2.62) | 647 (16.43) |
| Example 3 | 3.0 (7.62) | 50.0 (127.0) | 6.336 | 155 (3.94) | 932 (23.67) |
| Example 4 | 6.0 (15.24 | No Curl | 4.326 | 71 (1.80) | 458 (11.63) |
| Comparative C-1 | 0.4 (1.02) | 1.15 (2.92) | 6.616 | 192 (4.88) | 1063 (27.00) |
| Comparative C-2 | 0.25 (0.64) | 1.35 (3.43) | 5.253 | 107 (2.72) | 643 (16.33) |
| Comparative C-3 | 1.75 (4.45) | 4.0 (10.16) | 6.027 | 218 (5.54) | 1235 (31.47) |
| Comparative C-4 | 1.0 (2.54) | No Curl | 4.151 | 95 (2.41) | 575 (14.59) |

All of the patents and patent applications mentioned above are hereby expressly incorporated by reference. The embodiments described above are illustrative of the present invention and other constructions are also possible. Accordingly, the present invention should not be deemed limited to the embodiments described in detail above and shown in the accompanying drawings, but instead only by a fair scope of the claims that follow along with their equivalents.

What is claimed is:

1. An abrasive article comprising:

a flexible backing having a major surface, the major surface being a top surface;

a make resin contacting the major surface and extending over a portion of the major surface in a first pre-determined pattern of discrete coated regions;

individual abrasive grits contacting the make resin and generally in registration with the make resin as viewed in directions normal to the plane of the major surface; and a size resin extending over both the portion of the major surface and the make resin in a second pre-determined pattern of discrete coated regions and contacting both the individual abrasive grits and the make resin, the first and second pre-determined patterns being generally in registration with each other as viewed in directions normal to the plane of the major surface, wherein the size resin generally extends over areas of the major surface coated by the make resin and encapsulates the abrasive particles and the make resin, but does not generally extend over areas of the major surface not coated by the make resin, and wherein areas of the major surface contacting the make resin are generally coplanar with areas of the major surface not contacting the make resin, whereby the areas of the major surface not contacting the make resin remain uncoated at the top of the abrasive article.

2. An abrasive article comprising:

a flexible backing having a generally planar major surface, the major surface being a top surface; and a plurality of discrete islands on the major surface, each island comprising:

a make resin contacting the backing;

individual abrasive grits contacting the make resin; and a size resin contacting the make resin and the individual abrasive grits, wherein the size resin generally extends over areas of the major surface coated by the make resin and encapsulates the abrasive particles and the make resin, but does not generally extend over areas of the major surface not coated by the make resin, whereby the areas of the backing not contacting the make resin or size resin remain uncoated at the top of the abrasive article.

3. The abrasive article of claim 1, further comprising a supersize resin contacting the size resin and generally in registration with the size resin as viewed in directions normal to the plane of the major surface, the supersize resin providing enhanced lubricity.

4. The abrasive article of claim 1, wherein the individual abrasive grits have an average size ranging from 68 micrometers to 270 micrometers and the make resin has a coverage of at most 30 percent.

5. The abrasive article of claim 4, wherein the individual abrasive grits have an average size ranging from 68 micrometers to 270 micrometers and the make resin has a coverage of at most 20 percent.

6. The abrasive article of claim 5, wherein the individual abrasive grits have an average size ranging from 68 micrometers to 270 micrometers and the make resin has a coverage of at most 10 percent.

7. The abrasive article of claim 1, wherein the individual abrasive grits have an average size ranging from 0.5 micrometers to 68 micrometers and the make resin has a coverage of at most 70 percent.

8. The abrasive article of claim 7, wherein the individual abrasive grits have an average size ranging from 0.5 micrometers to 68 micrometers and the make resin has a coverage of at most 60 percent.

9. The abrasive article of claim 8, wherein the individual abrasive grits have an average size ranging from 0.5 micrometers to 68 micrometers and the make resin has a coverage of at most 50 percent.

10. The abrasive article of claim 1, wherein the pattern comprises a plurality of replicated clusters of features.

11. The abrasive article of claim 10, wherein each cluster has three or more generally circular features arranged in a polygonal shape.

12. The abrasive article of claim 11, wherein each cluster has seven generally circular features arranged in a hexagonal shape.

13. The abrasive article of claim 1, wherein the pattern is a random array of generally circular features.

14. The abrasive article of claim 1, wherein an 11.4 centimeter by 14.0 centimeter sheet of the abrasive article that is conditioned at 32.2 degrees Centigrade and 90% relative humidity for 4 hours displays a curl radius of at least 20 centimeters.

15. The abrasive article of claim 14, wherein the sheet displays a curl radius of at least 50 centimeters.

16. The abrasive article of claim 15, wherein the sheet displays a curl radius of at least 100 centimeters.

17. The abrasive article of claim 1, wherein the make resin has a coverage of at most 30 percent.

18. The abrasive article of claim 17, wherein the make resin has a coverage of at most 20 percent.

19. The abrasive article of claim 17, wherein the make resin has a coverage of at most 10 percent.

* * * * *